United States Patent [19]

Zaiser

[11] Patent Number: 4,595,360

[45] Date of Patent: Jun. 17, 1986

[54] FIXTURE FOR USE DURING MANUFACTURE OF WING STRUCTURE

[76] Inventor: LeNoir E. Zaiser, 1825 8th St., South, Naples, Fla. 39440

[21] Appl. No.: 670,645

[22] Filed: Nov. 13, 1984

[51] Int. Cl.[4] ..... F27D 5/00

[52] U.S. Cl. ..... 432/253

[58] Field of Search ..... 432/253; 72/701

[56] References Cited

U.S. PATENT DOCUMENTS 2,803,449 8/1957 Ludwig ..... 432/253

*Primary Examiner*—John J. Camby

*Attorney, Agent, or Firm*—Finnegan, Henderson, Farabow, Garrett & Dunner

[57] ABSTRACT

A fixture for holding wing structures during heat bonding of their skins, the wing structures each including a base along the root thereof defined by a pair of elongated base flanges and an elongated slot extending into the root centrally between the base flanges. The fixture comprises an elongated, rigid member including an elongated surface portion curved at a predetermined radius which tapers from approximately the central area of the member to one end thereof toward the axis of the member to induce a distortion in the wing structure sufficient to compensate for thermally induced dimensional changes in the wing structure after removal from the fixture. The fixture also includes an elongated key flange radially extending from the curved surface portion for cooperating with a slot in the base of the wing structure to align the wing structure with the longitudinal axis of the member and screws for securing the base flanges of the wing structure to the curved surface on opposite sides of the key.

17 Claims, 4 Drawing Figures

FIXTURE FOR USE DURING MANUFACTURE OF WING STRUCTURE

BACKGROUND OF THE INVENTION

1. Field of the Invention

This invention relates to a fixture for use during steps in the manufacturing process of a wing structure, and more particularly for a fixture to hold at least one wing sub-assembly structure for the Mark I Mod 2 (AIM-9) Sidewinder Missile.

2. Description of Related Art

The wing sub-assembly for the Sidewinder missile includes a forged aluminum frame and a honeycomb core over which an aluminum skin and metallic structural adhesive are bonded. The bonding process requires the application of heat and vacuum or positive pressure to the wing structure.

Production of the Sidewinder wing, or similar wing structures, sometimes commonly called the Chaparral wing, has been performed for approximately 15 years. Until the subject invention, manufacturers of the Sidewinder wing sub-assembly have been unable to manufacture such wings which meet all dimensional tolerances required by the U.S. government. In particular, the dimensions of the wing base had exceeded dimensional tolerances when measured at the final assembly. The United States government has been forced to accept the wings despite the variations from the specifications due to the inability of the manufacturers to meet the tolerances.

Through experimentation, the inventor has determined that the cause of the distortion in the final wing sub-assembly is caused by one or more of the following: internal stress in the wing forgings, stress caused by machining, distortion caused by clamping of irregular forged surfaces during machining, distortion caused by applying pressure, either through a vacuum, through the combination of vacuum and positive external pressure, or mechanical pressure, to the wing surfaces during the heat bonding process, and shrinkage from bonding at high temperature and cooling.

The subject invention provides a fixture to which the wing structures are attached during the wing bonding process and which reduces and compensates for the distortions described above to provide a wing sub-assembly conforming to the specifications of the U.S. government for the base characteristics of the wing sub-assembly.

Advantages of the invention are set forth in part in the description which follows, and in part will be obvious from the description, or may be learned by practice of the invention.

SUMMARY OF THE INVENTION

The objects and advantages of the invention may be realized and attained by means of the instrumentalities and combinations particularly pointed out in the appended claims.

The invention as broadly described herein comprises a fixture for holding a wing structure during steps of its manufacture, the root of the wing structure including a pair of opposed, elongated base flanges forming a generally C-shaped base, an elongated slot extending generally parallel to and centrally located between the base flanges, and conduits for fluid communication between the root and the remote areas of the wing structure. The fixture includes an elongated, rigid member including an elongated surface portion curved at a predetermined radius and means for inducing a distortion in the wing structure sufficient to compensate for thermally induced dimensional changes in the wing structure after removal from the fixture; elongated key means radially extending from the curved surface portion for cooperating with the slot to rigidly align the wing structure with the longitudinal axis of the member, and means for removably securing the base flanges to the curved surface portion on opposite sides of the key means.

Preferably, the elongated member is cylindrical in shape with a radius equal to the predetermined radius.

It is preferred that the means for inducing a distortion comprise a taper in the diameter of the member for a predetermined part of its length, the degree and length of the taper being determined by the effect of the thermally induced dimensional changes in the wing structure.

It is also preferred that the member include a central bore and a port in the curved surface portion providing fluid communication between the bore and the conduits in the root of the wing structure and the member include means for communicating the bore to a negative pressure source sealingly through a wall of an airtight container enclosing the fixture and the wing structure mounted thereon.

In the embodiment depicted herein, the key means comprise an elongated, generally planar key flange rigidly secured to and radially extending from the curved surface portion, the planar key flange being generally co-planar with the longitudinal axis of the member. Such a key flange may extend from both sides of the member and provide means for securing two wing structures to a single fixture.

The securing means is preferably a plurality of axially spaced wing base screws disposed in holes in both base flanges of the wing structure which are received in openings in the planar key flange, or clamping the length of the base.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

Reference will now be made in detail to the present preferred embodiment of the invention, examples of which are illustrated in the accompanying drawings.

Figure 1:
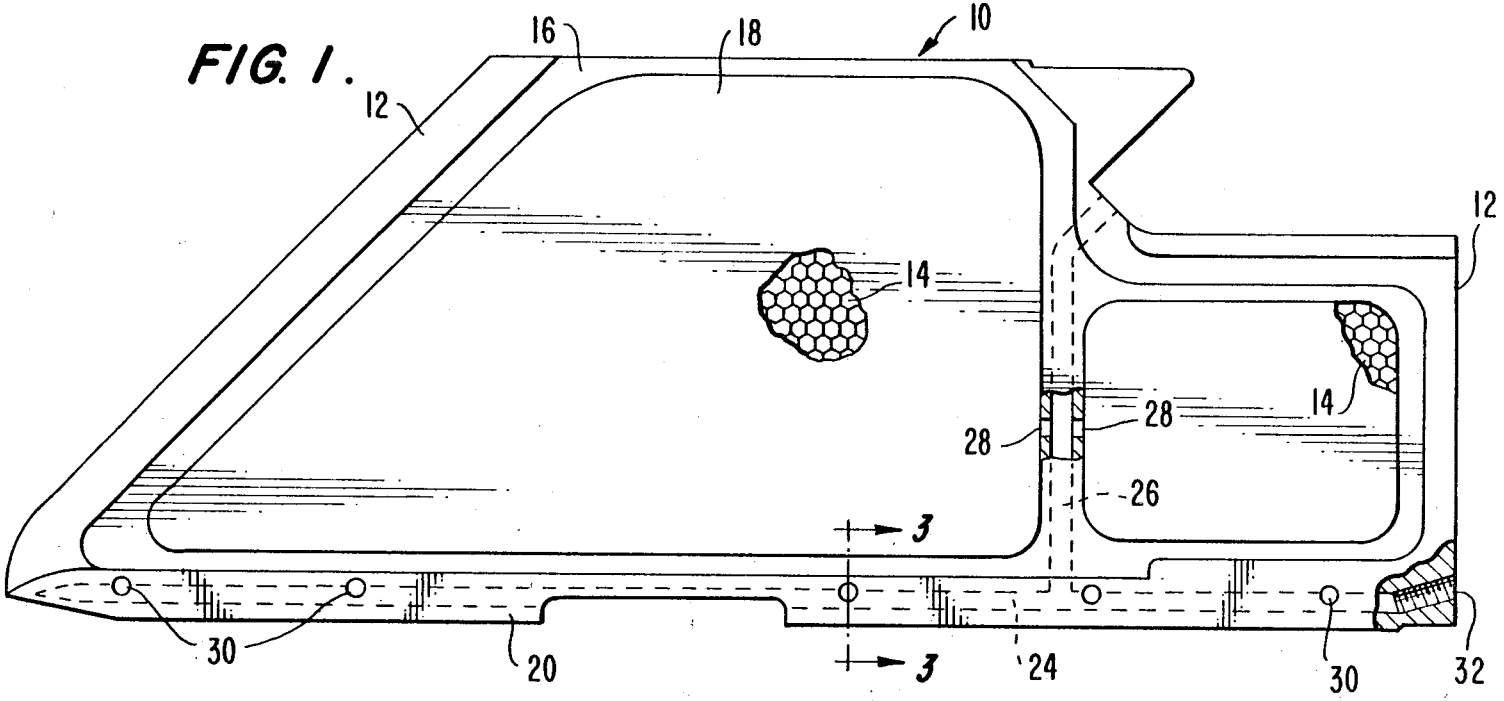
FIG. 1 is a partially cut-away, plan view of the wing structure of a Sidewinder wing sub-assembly.
Figure 3:
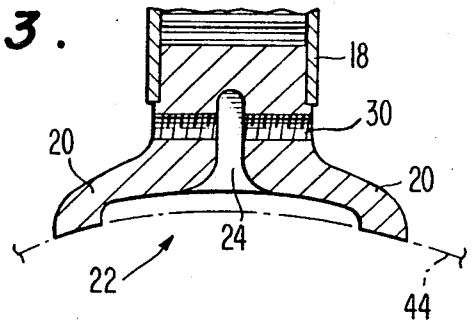
FIG. 3 is a cross-sectional view taken along lines 3—3 of FIG. 1 of the base portion of the wing structure.
Figure 2:
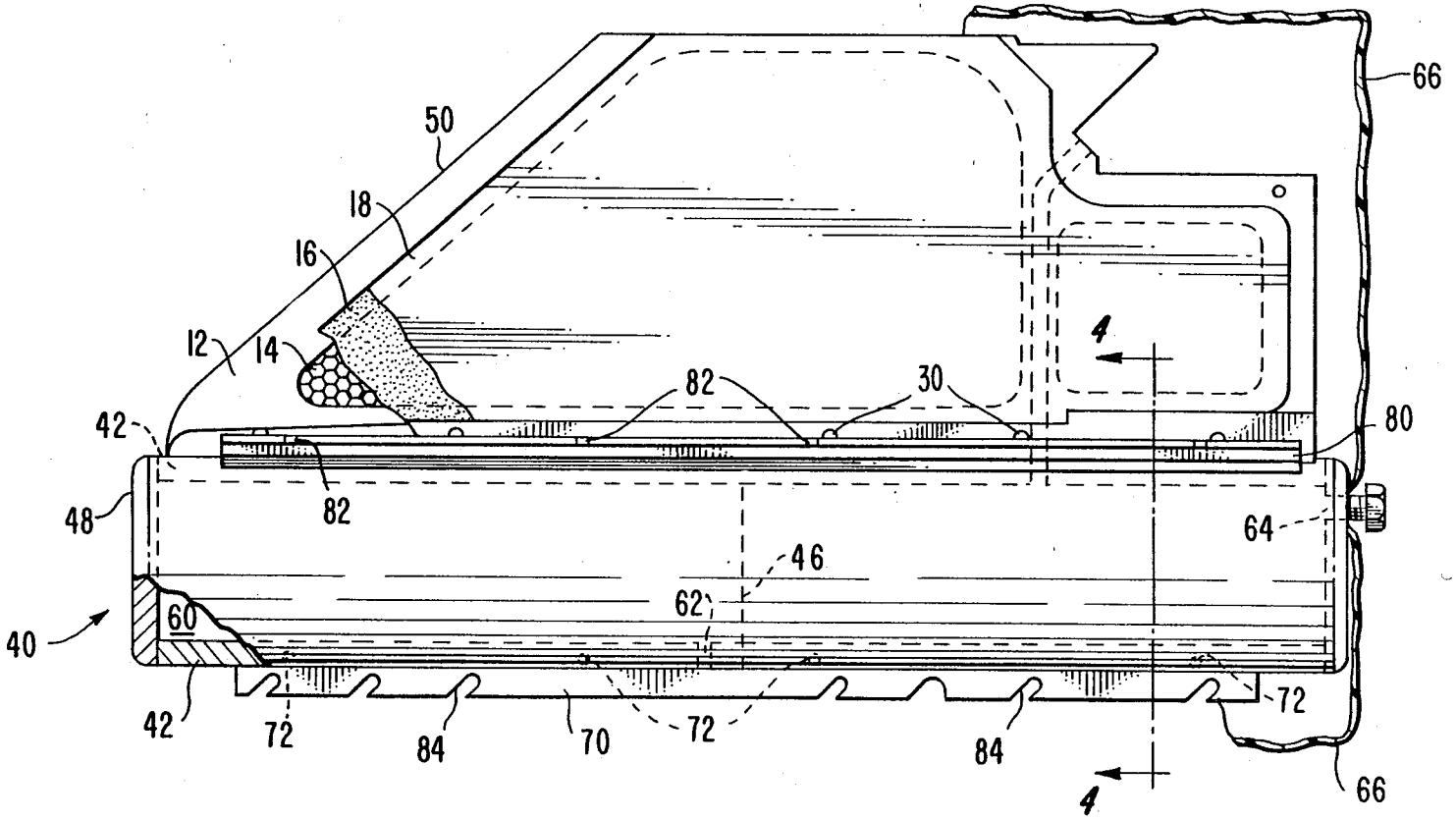
FIG. 2 is a plan view of the fixture of the invention depicting two embodiments of the securing means and having the wing structure attached thereto.

The invention is directed to a fixture for holding a wing structure during steps of its manufacture. As seen in FIGS. 1 and 2, the wing structure 10 includes a forged aluminum frame 12, a honeycomb core 14, metallic structural adhesive 16, and an aluminum skin 18. Referring to FIGS. 1 and 3, the wing structure 10 has a root including a pair of opposed, elongated base flanges 20 forming a generally C-shaped base 22, an elongated slot 24 extending generally parallel to and centrally located between base flanges 20, and conduits 26 communicating through ports 28 between the root of the wing structure and the remote honeycomb areas of the wing structure.

The root portion of the wing portion also includes threaded holes 30 for threadably receiving wing base screws. The threaded holes and wing base screws are used to secure the wing to the missile. The wing structure root area also includes threaded hole 32 at the trailing edge thereof for receiving a screw to bear against a key flange to which the wing is secured in order to seat the wing base screws into slots in the key flange.

As mentioned above, certain of the structural dimensions of the base portion of the wing structure have not been able to be achieved in prior art manufacturing techniques. Among the areas where these deficiencies occur are in the dimension of the curve 44 defined by the generally C-shaped base 22, the dimension and trueness of the threaded openings 30 for receiving the wing base screws, and the trueness of the slot 24. The subject invention provides a means for processing the wing structure during the bonding step while achieving the required dimensional characteristics of these and other aspects of the wing.

In accordance with the invention, the fixture comprises an elongated, rigid member including an elongated surface portion curved at a predetermined radius and means for inducing a distortion in the wing structure sufficient to compensate for thermally induced dimensional changes in the wing structure after removal from the fixture. In the preferred embodiment depicted in FIGS. 2 and 4, the fixture comprises generally cylindrical, elongated rigid member 40 including an elongated surface portion 42 curved at a predetermined radius. The predetermined radius of the curved surface portion is preferably equal to the required radius of the curve 44 (FIG. 3) defined by base flanges 20. This predetermined radius may vary depending upon the desired dimensions of the base of the wing structure being processed.

It is preferred that the elongated rigid member have sufficient structural strength to preclude distortion of the member and to force a wing structure into a desired shape during a heat bonding process. The member 40 must be accurately machined to ensure that its dimensions are accurate and true.

Because the wing structure is substantially heated and subjected to pressure during the bonding process, distortions in the structure occur after that process during cooling. Accordingly, the invention includes means for inducing a distortion which would compensate for these thermally induced dimensional changes. In the embodiment described herein, the means for inducing a distortion comprises a taper in the diameter of the member for a predetermined part of its length. As seen in FIG. 2, preferably the taper begins approximately in the center 46 of the member and continues symmetrically to one end 48. The leading edge 50 of the wing structure is secured adjacent the tapered end 48 of the member.

The degree and length of the tapered portion is determined by the effect of the thermally induced dimensional changes in the wing structure. Experiments have shown that a taper beginning at the mid-point of the member and symmetrically continuing to one end such that the diameter at the one end is 0.015 inches less than the diameter at the beginning of the tapered portion is sufficient for compensating for thermally induced distortions in the Sidewinder wing.

The subject invention is not limited to the embodiment wherein the member is cylindrical. It is possible to have a generally rectangular member one side of which is curved to the predetermined radius and constitutes the curved portion of the surface. In such an embodiment, the taper, which may also begin at approximately the middle of the member, will continue symmetrically along the curved portion of the member to one end. In such an embodiment, the distance of the curved surface portion from the longitudinal axis of the member may be approximately 0.0075 inches less than that distance at the beginning of the tapered portion.

The preferred embodiment wherein the member is cylindrical in shape has the advantage of providing at least two curved surfaces to which wing structures may be attached. Thus symmetrical reduction in diameter of the cylindrically shaped member will provide an appropriate taper for each such curved surface.

In some processes it may be preferable to conduct vacuum to the inside portion of the wing structure. Accordingly, it is preferred that the member 40 include a central bore 60 and a port 62 in each curved surface portion providing fluid communication between the bore 60 and conduits 26 in the root of the wing structure. The bore 60 may then be communicated to a vacuum source which vacuum is then communicated through port 62 and conduits 26 to the internal portions of the wing structure. In order to communicate vacuum to the bore 60, the preferred embodiment includes port 64 at one end of the member 40 providing fluid communication between the bore and a source of negative pressure (not shown). Since the thermal bonding process by which the skin is secured to the wing structure requires the application of vacuum pressure and/or autoclave pressure to the wing structure, the process may require placing the wing structure and fixture within an air tight container such as a vacuum bag. As seen in FIG. 2, the wing structure and fixture is disposed in vacuum bag 66. In order to communicate vacuum to bore 60, it is necessary to seal the vacuum bag to member 40 around port 64 providing access for communication of vacuum through port 64 to bore 60.

In accordance with the invention, the fixture includes elongated key means radially extending from the curved surface portion for cooperating with the slot to rigidly align the wing structure with the longitudinal axis of the member.

Figure 4:
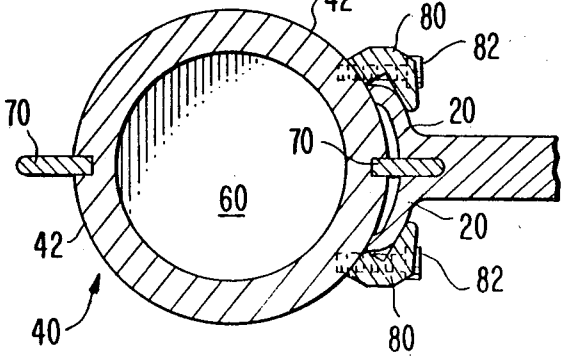
FIG. 4 is a cross-sectional view of the fixture and wing structure taken along lines 4—4 in FIG. 2.

As embodied herein and depicted in FIGS. 2 and 4, the key means comprises an elongated, generally planar key flange 70 rigidly secured to and radially extending from the curved surface portion 42 of member 40. The planar key flange preferably is coplanar with the longitudinal axis of the member 40. In the preferred embodiment, the member includes a pair of opposed curved surface portions 42 and a pair of opposed planar key flanges 70, the key flanges being rigidly secured to and radially extending from respective sides of member 40 and being coplanar with each other and with the longitudinal axis of the member.

The key flanges 70 may be secured to member 40 by any known means provided the key flanges are rigid. As depicted in FIG. 2, key flange 70 is disposed in a slot in curved surface 42 and secured by screws, rivets, or spot welding 72. The length of each key flange will be generally equal to the length of the root portion of the wing structure. As the key flange is disposed in the slot 24 in the root portion of the wing structure, its length and dimensions are dictated by the length and dimensions of the slot 24.

In accordance with the invention, the fixture further comprises means for removably securing the base flanges to the curved surface portion on opposite sides of the key means. The securing means must be strong enough to distort the wing structure during processing.

In one embodiment depicted in FIGS. 2 and 4, the securing means comprises a pair of elongated clamps 80, one disposed on each side of the key flange 70 for engaging the end of a respective one of the base flanges 20 substantially throughout its length. A plurality of screws 82 are disposed in holes in each clamp 80 threadably received in openings in the curved surface portion 42 of member 40. As seen in FIG. 4, clamps 80 and screws 82 rigidly secure base flanges 20 to the curved surface portion 42 to force base flanges 20 into the desired radial dimension. The force of the clamps 80 on base flanges 20 over the tapered portion of member 40 distorts the leading edge portion of the wing structure to a desired degree.

In another embodiment, the securing means comprises a plurality of axially spaced wing base screws threadably received in bores 30 in base flanges 20 of the wing structure. The wing base screws pass through slots 84 in key flange 70. A screw is then inserted in threaded bore 32 (FIG. 1) and tightened to bear against the end of key flange 70 to force the shafts of the wing base screws into slots 84 thereby securely affixing the wing structure to the member in a manner comparable to that used to affix the wing structure to the missile.

The fixture of the invention is employed to eliminate distortion created by pressure and shrinkage in the bonding process of a wing sub-assembly. This fixture, if properly employed, will improve the strength and characteristics of the machined wing frame during the bonding process to create a wing sub-assembly more accurate and true after the bonding process than before. It has been determined that the fixture of the invention produces a wing sub-assembly meeting the dimensional requirements of the specifications of the United States government for the Sidewinder wing sub-assembly and related wing assemblies.

It will be apparent to those skilled in the art that various modifications and variations could be made to the fixture of the invention without departing from the scope or spirit of the invention.

What is claimed is:

1. A fixture for holding a wing structure during steps of its manufacture, the root of said wing structure including a pair of opposed, elongated base flanges forming a generally C-shaped base, an elongated slot extending generally parallel to and centrally located between said-base flanges, and conduits for fluid communication between said root and remote areas of said wing structure, said fixture comprising:

(a) an elongated, rigid member including an elongated surface portion curved at a predetermined radius and means for inducing a distortion in said wing structure sufficient to compensate for thermally induced dimensional changes in said wing structure after removal from said fixture;

(b) elongated key means radially extending from said curved surface portion for cooperating with said slot to rigidly align said wing structure with the longitudinal axis of said member; and (c) means on opposite sides of said key means for removably securing said base flanges to said curved surface portion.

2. The fixture of claim 1 wherein said member has sufficient structural strength to preclude distortion of said member and to force a wing structure into a desired shape during a heat bonding process.

3. The fixture of claim 1 wherein said member is generally cylindrical in shape with a radius equal to said predetermined radius.

4. The fixture of claim 1 wherein said distortion inducing means comprises a taper in said curved surface toward the longitudinal axis of said member for a predetermined part of its length, the degree and length of said taper being determined by the effect of said thermally induced dimensional changes in said wing structure.

5. The fixture of claim 3 wherein said distortion inducing means comprises a taper in the diameter of said member for a predetermined part of its length, the degree and length of said taper being determined by the effect of said thermally induced dimensional changes in said wing structure.

6. The fixture of claim 4 wherein said tapered portion begins at approximately the middle of said member and is symmetrically tapered to one end thereof.

7. The fixture of claim 6 wherein the distance between said longitudinal axis and said curved portion at said one end is 0.0075 inches less than at the beginning of said tapered portion.

8. The fixture of claim 5, wherein said tapered portion begins at approximately the middle of said member and is symmetrically tapered to one end thereof.

9. The fixture of claim 8 wherein the diameter of said member at said one end is 0.015 inches less than at the beginning of said tapered portion.

10. The fixture of claim 6 or 8, wherein said wing structure is secured to said member with its leading edge proximate said one end of said member.

11. The fixture of claim 1 wherein said member has a central bore and a port in said curved surface portion providing fluid communication between said bore and said conduits in said root and wherein said member includes means for communicating said bore to a negative pressure source sealingly through a wall in an air tight container enclosing said fixture and a wing structure mounted thereon.

12. The fixture of claim 1 wherein said key means comprises an elongated, generally planar key flange rigidly secured to and radially extending from said curved surface portion, said key flange being generally coplanar with the longitudinal axis of said member.

13. The fixture of claim 5 wherein said member includes a pair of opposed curved surface portions.

14. The fixture of claim 13 wherein said key means comprises an elongated, generally planar key flange rigidly secured to and radially extending from each of said pair of opposed curved surface portions, said key flanges being generally coplanar with each other and with the longitudinal axis of said member.

15. The fixture of claim 1 wherein said securing means comprises a plurality of axially spaced wing base screws threadably received in coaxial holes in said base flanges and passing through slots in said key means when said key means is disposed in the slot of said wing structure.

16. The fixture of claim 1 wherein said securing means comprises a pair of elongated clamps, one disposed on each side of said key means for engaging the end of a respective one of said base flanges substantially throughout its length, and a plurality of screws for securing said clamps to said member.

17. A fixture for holding wing structures during heat bonding of their skins, said wing structures each including a base along the root thereof defined by a pair of elongated base flanges and an elongated slot extending into said root centrally between said flanges, said fixture comprising:

(a) an elongated, rigid, cylindrical member having a predetermined radius, the diameter of said member symmetrically tapering from approximately the center to one end thereof;

(b) a pair of opposed, elongated key flanges rigidly secured to and radially extending from opposite sides of said member in a plane including the longitudinal axis of said member, said key flanges being disposed for cooperation with said slots to rigidly align said wing structures with the longitudinal axis of said member; and (c) means for removably securing the flanges of said wing structures to said member with said key flanges in said slots, said member and said securing means having sufficient strength to force said wing structures into a desired shape during said heat bonding process.

* * * * *